US007458188B2

(12) United States Patent
Mears

(10) Patent No.: US 7,458,188 B2
(45) Date of Patent: Dec. 2, 2008

(54) STRUCTURAL ALIGNMENT MEMBER

(75) Inventor: Charles W. Mears, Forest Lake, MN (US)

(73) Assignee: Radius Track Corporation, Coon Rapids, MN (US)

( * ) Notice: Subject to any disclaimer, the term of this patent is extended or adjusted under 35 U.S.C. 154(b) by 453 days.

(21) Appl. No.: 10/974,623

(22) Filed: Oct. 27, 2004

(65) Prior Publication Data

US 2005/0086902 A1 Apr. 28, 2005

Related U.S. Application Data

(60) Provisional application No. 60/514,847, filed on Oct. 27, 2003.

(51) Int. Cl.
*E04H 12/00* (2006.01)

(52) U.S. Cl. ..... 52/300; 52/716.1; 52/245

(58) Field of Classification Search ..... 52/716.1, 52/716.6, 718.04, 717.03, 241, 246, 247, 52/720.1, 733.1, 300, 293.3
See application file for complete search history.

(56) References Cited

U.S. PATENT DOCUMENTS

| | | | | |
|---|---|---|---|---|
| 1,714,174 | A | 5/1929 | Lichtenberg et al. | |
| 1,901,789 | A | 3/1933 | Wimberley | |
| 2,269,384 | A | 1/1942 | Spinosa | |
| 2,419,321 | A | 4/1947 | Lopes | |
| 3,053,358 | A | 9/1962 | Gross | |
| 3,260,022 | A * | 7/1966 | Reynolds et al. | 52/86 |
| 3,295,269 | A | 1/1967 | Schuster | |
| 3,505,714 | A | 4/1970 | Boileau | |
| 4,805,364 | A | 2/1989 | Smolik | |
| 4,887,397 | A | 12/1989 | Peterson | |
| 4,894,962 | A | 1/1990 | Conn | |
| 5,090,170 | A | 2/1992 | Propst | |
| 5,291,714 | A | 3/1994 | Wright et al. | |
| 5,291,717 | A | 3/1994 | Turner | |
| 5,394,665 | A | 3/1995 | Johnson | |
| 6,000,181 | A * | 12/1999 | Wheeler | 52/241 |
| 6,138,359 | A | 10/2000 | Mears | |
| 6,237,301 | B1 * | 5/2001 | Paradis | 52/717.03 |
| 6,434,908 | B1 * | 8/2002 | Ferrante | 52/731.7 |
| 6,625,942 | B1 | 9/2003 | Wheeler | |
| 6,637,173 | B1 | 10/2003 | Wheeler | |

FOREIGN PATENT DOCUMENTS

| | | |
|---|---|---|
| EP | 0453415 | 4/1991 |

* cited by examiner

*Primary Examiner*—Richard E Chilcot, Jr.
*Assistant Examiner*—Jessica Laux
(74) *Attorney, Agent, or Firm*—Haugen Law Firm PLLP

(57) ABSTRACT

A structural alignment member for use in operably receiving a plurality of structural support members in a customizable arrangement includes a unitary main body having an elongated base portion and first and second end flanges extending upwardly from first and second substantially opposed sides thereof. The main body is partially separated into a plurality of support member receptor portions, between which are disposed one or more preformed creases in at least one of the base portion and the first end flange. The preformed creases integrally interconnect respective adjacent pair of support member receptor portions.

5 Claims, 9 Drawing Sheets

STRUCTURAL ALIGNMENT MEMBER

CROSS REFERENCE TO RELATED APPLICATIONS

This application claims priority from U.S. Provisional Patent Application Ser. No. 60/514,847 filed on Oct. 27, 2003 and entitled "Structural Alignment Member", the content of which is incorporated herein in its entirety.

FIELD OF THE INVENTION

The present invention relates to structural support devices generally, and more particularly to support and alignment devices which are configured to receive and align building structures in a variety of configurations, including along non-linear paths.

BACKGROUND OF THE INVENTION

A problem that has long existed in the construction industry is in the methods required to produce supported curves, such as in curved wall and ceiling constructions. In the past, curved constructions have been formed by attaching together a plurality of distinct receptor or support members such that, in combination, a curved support surface is created. Such a method is extremely time consuming and expensive, in that workers must individually lay-up and align each distinct piece in a desired pattern to thereby enable construction of a supported structure in a desired configuration.

Structural support devices currently available for constructing curved wall or arch segments typically employ a design that allows for curvature in a single plane. Some conventional devices involve a plurality of distinct parts which result in a relatively expensive system that is time consuming and complex to securely shape into a desired configuration. Moreover, such conventional devices do not allow for curvature forming along a plurality of distinct planes while retaining a relatively high level of strength and rigidity in the structural support device.

It is therefore a principle object of the present invention to provide a structural support device which may be quickly manipulated into a wide variety of linear and non-linear conformations along one or more distinct planes.

It is a further object of the present invention to provide a structural support and alignment device having a plurality of support member receptor locations positionable along a variety of linear and non-linear orientations.

It is a still further object of the present invention to provide a support member alignment device of unitary construction that is readily manipulatable into configurations along multiple distinct planes.

SUMMARY OF THE INVENTION

By means of the present invention, efficient and inexpensive construction of curved walls, arch segments, and the like is facilitated. Moreover, the structural alignment apparatus of the present invention provides for overall strength and rigidity to building forms both before and after repositioning into a desired configuration. Through the utilization of the apparatus of the present invention, structural support members such as wall studs may be operably positioned in a relative arrangement along a plurality of planes. Such an arrangement includes curves extending in more than one plane.

In a particular embodiment, the structural alignment member of the present invention includes a unitary main body having an elongated base portion with an upper surface and an opposed lower surface, as well as first and second substantially opposed sides extending along a length of the base portion. The main body further includes first and second end flanges that extend upwardly from the upper surface of the base portion at the first and second sides, and along the length of the base portion. The main body is preferably partially separated into a plurality of support member receptor portions, with one or more preformed creases being disposed in at least one of the base portion and the first end flange between respective adjacent support member receptor portions to thereby integrally interconnect the adjacent support member receptor portions.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various embodiments of the invention. Other embodiments and aspects of the invention are recognized as being within the grasp of those having ordinary skill in the art.

Figure 1:
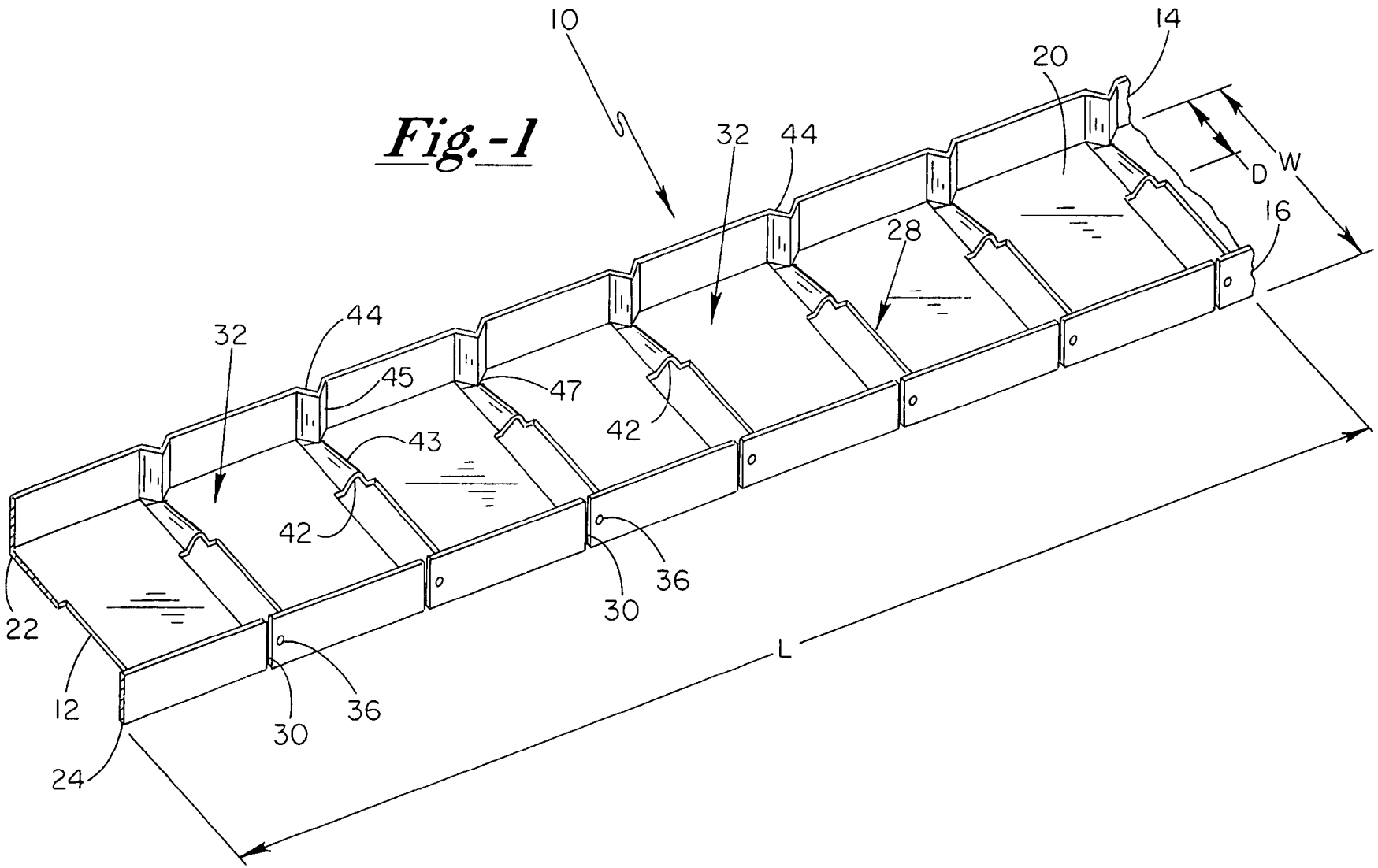
FIG. 1 is a perspective view of a structural alignment member of the present invention.

With reference now to the drawing figures, and first to FIG. 1, structural alignment member 10 preferably includes an elongated base portion 12 and first and second end flanges 14, 16 extending upwardly from an upper surface 20 of base portion 12. First and second end flanges 14, 16 preferably extend from respective opposed first and second sides 22, 24, such that first and second end flanges 14, 16, in combination, form distally opposed upstanding walls with respect to base portion 12.

As further illustrated in FIG. 1, base portion 12 includes one or more cutout portions 28 transversely oriented with respect to elongated base portion 12. Such cutout portions 28 preferably extend from second side 24 to a position at least partially across the width of base portion 12, as defined between first and second sides 22, 24. In preferred embodiments of the present invention, cutout portions 28 extend across at least 30% of width "W" from second side 24, and more preferably extend at least 50% across width "W". In a particularly preferred embodiment of the present invention, cutout portion 28 extends between about 60% and 80% across width "W" of base portion 12 from second side 24 thereof. However, certain embodiments, such as that depicted in FIG. 6, contain cutout portions 28 which do not extend from second side 24 of base portion 12. Thus, another method of defining the transverse dimension of cutout portions 28 is between first crease 42 and overlay tab 72, or between first crease 42 and second side 24. First crease 42 has a dimension "D" of between about one and three inches, and is selected to meet application characteristics.

In addition, the one or more cutout portions 28 are preferably longitudinally spaced apart along length "L" so as to define individual support member receptor portions 32 of alignment member 10 therebetween.

Preferably, cutout portions 28 are longitudinally spaced apart along length "L" at predetermined spaced intervals, which intervals preferably correspond to standardized spacing for structural support members being aligned and placed on member 10. For example, cutout portions 28 may be longitudinally spaced apart at 4 inch intervals so as to provide receptor portions 32 at locations divisible by standardized support member spacing of 4, 8, 12, 16, or 24 inches on center. In such a manner, the desired support member spacing will preferably correspond to the placement of such support members on respective receptor portions 32 of alignment member 10. In addition, cutout portions 28 are preferably positioned in base portion 12 along a predetermined longitudinally spaced array so as to provide a desired flexibility characteristic to alignment member 10.

Such flexibility is further enhanced by respective cuts 30 extending upwardly through second end flange 16. Such cuts 30 separate second end flange 16 into distinct end flange portions integrally formed and associated with support member receptor portions 32. In such a manner, such support member receptor portions 32 incorporate distinct respective second end flange portions of second end flange 16, and are integrally connected with adjacent receptor portions 32 only at the commonly-extending first end flange 14 and at respective portions of base portion 12 not separated by cutout portions 28. Accordingly, the separation of alignment member 10 into only partially integrated receptor portions 32 enables an overall flexibility characteristic to alignment member 10, in that alignment member 10 may be manipulated into configurations along a plurality of distinct planes.

Figure 1A:
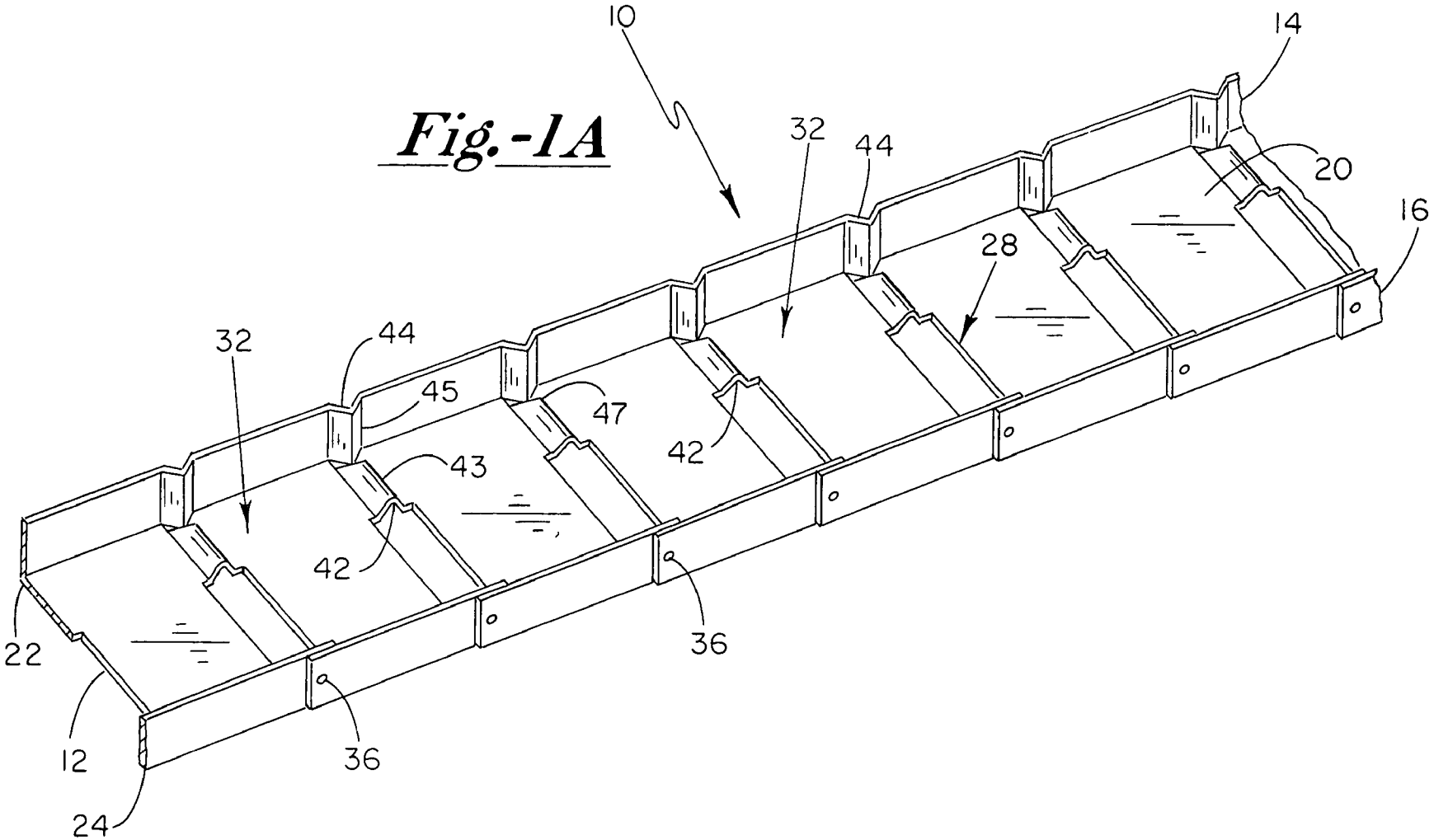
FIG. 1A is a perspective view of a structural alignment member of the present invention.
Figure 2:
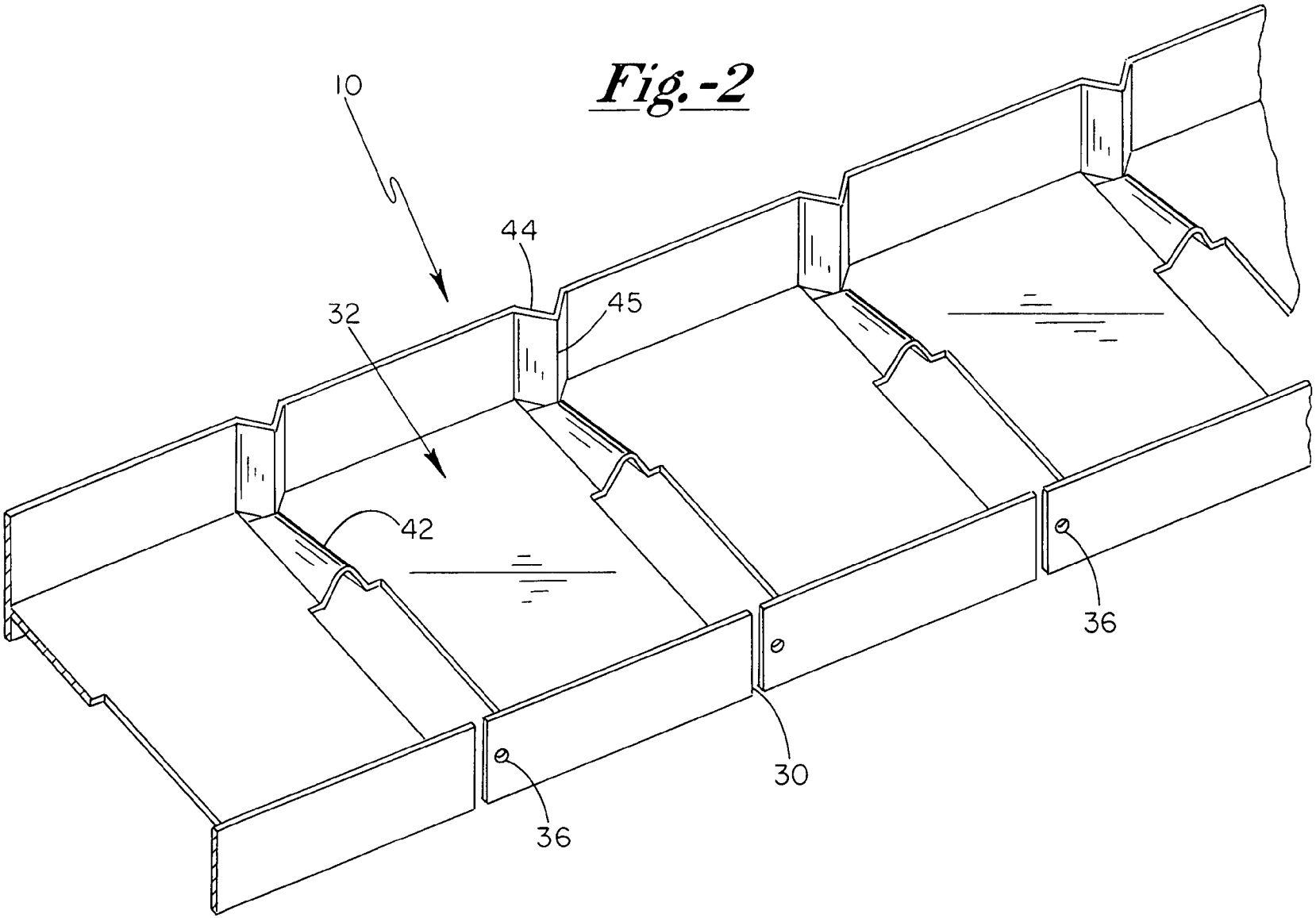
FIG. 2 is an enlarged perspective view of a portion of the structural alignment member illustrated in FIG. 1.
Figure 2A:
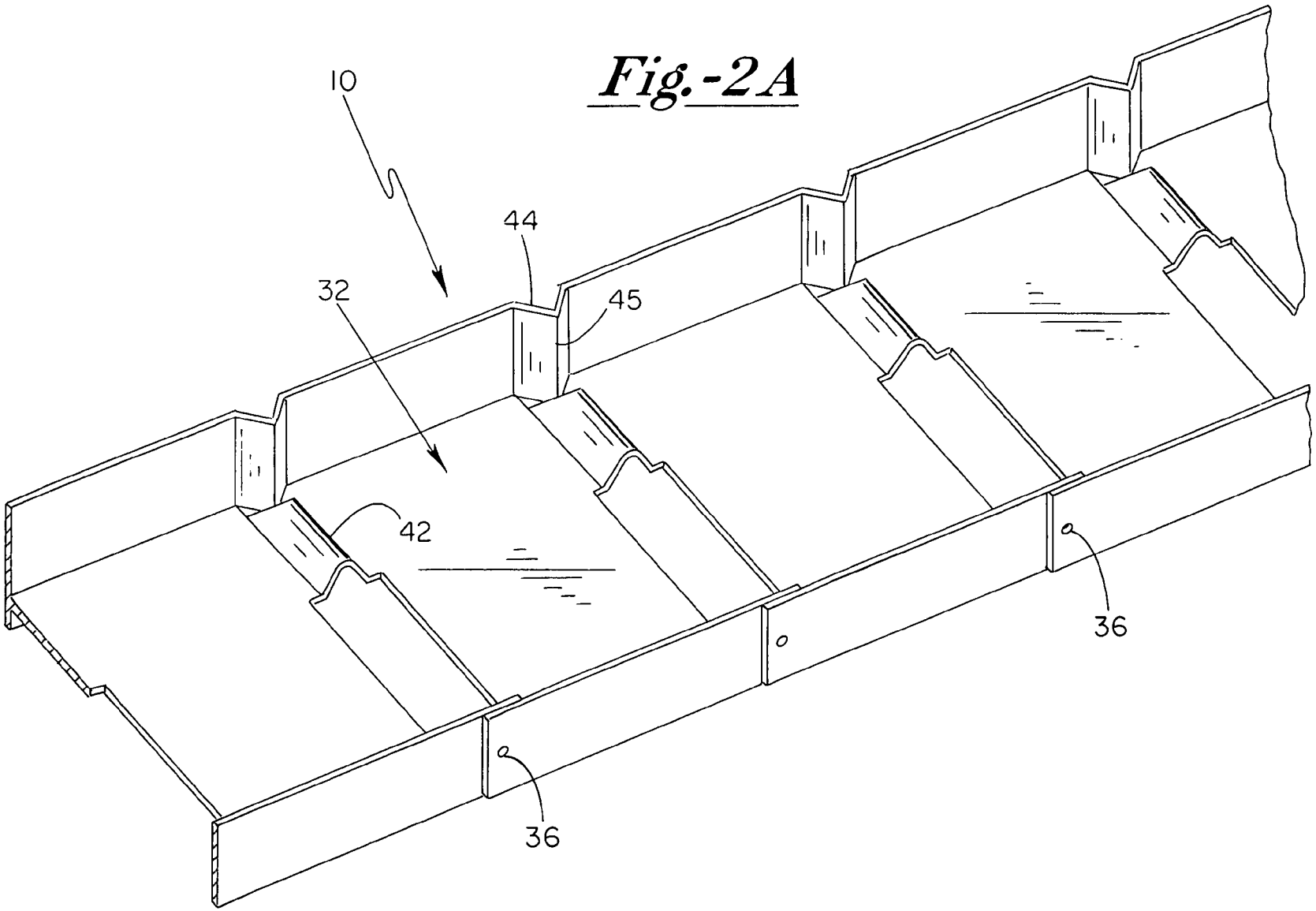
FIG. 2A is an enlarged perspective view of a portion of the structural alignment member illustrated in FIG. 1A.

Though second end flange 16 is illustrated in FIGS. 1 and 2 as being separated by respective cuts 30, it is to be understood that upon formation of first and/or second creases 42, 44, and the overall length "L" of apparatus 10 is reduced, thereby causing adjacent sections of second end flange 16 to overlap, even when apparatus 10 is in a substantially linear configuration, as is shown in FIGS. 1A and 2A.

In preferred embodiments of the present invention, cutout portions 28 are between about 0.25 and 2 inches in dimension as measured along a length axis "L". Such a dimension may be determined at the manufacturing stage so as to best comport with the particular use characteristics envisioned for the respective structural alignment member 10. As the dimension of cutout portion 28, as measured along axis "L", increases, the overall flexibility of alignment member 10 increases, but the overall structural strength correspondingly decreases. As such, a balance must be struck between the relative size of cutout portion 28, both along the transverse and longitudinal axes, against the flexibility and strength characteristics desired. As such, the dimension of cutout portions 28 along a longitudinal "L" axis, as stated above, is between about 0.25 and about 2 inches, and more preferably between about 0.5 and 1.5 inches.

An additional aspect of the present invention is in the fact that width "W" of base portion 12 preferably corresponds with standard support member widths. For example, structural support members such as wall or ceiling studs, typically are manufactured in standard widths of 3.5 inches, 3.625 inches, 5.5 inches, 6 inches, and so on. Width "W" of base portion 12, therefore, corresponds to such standardized dimensions so as to securely position respective structural support members at respective support member receptor portions 32 between first and second end flanges 14, 16.

As is further illustrated in FIGS. 1 and 2, respective second end flange portions preferably each include fastener apertures 36 disposed adjacent to a longitudinal end and adjacent to center of the second end flange height, to thereby create a continuous hinge in second end flange 16 once fasteners have been properly installed. Such positioning for fastener apertures 36 is important such that in operation, respective second end flange portions are partially overlapped with adjacent ones of another in order to manipulate structural alignment member 10 into a desired non-linear and/or non-planar configuration. Utilizing the flexibility characteristics described above, a user or the manufacturer of structural alignment member 10 may modify the overall shape thereof by adjusting the relative positions of adjacently disposed support member receptor portions 32. To effect such a modification, respective adjacent second end flange portions 16 partially overlap with one another, with such overlapping being manipulated so as to be in a planar or non-planar orientation, as desired. Once a desired relative orientation between adjacent support member receptor portions 32 is obtained through overlapping manipulation thereof, a fastener, such as a screw or the like, may be inserted into a respective fastener aperture 36 and subsequently through the overlapped portion of an adjacent second end flange section. In such a manner, the fastener secures the adjacent support member receptor portions 32 to one another in the desired relative orientation by grasping respective overlapped portions of adjacent second end flange portions. Though fasteners or other clamping means are preferred for securing the overlapped portions together, the materials comprising alignment member 10 are such that the so manipulated overlapped portions substantially retain their respectively modified orientation without the use of such fasteners or other clamping means.

Figure 3:
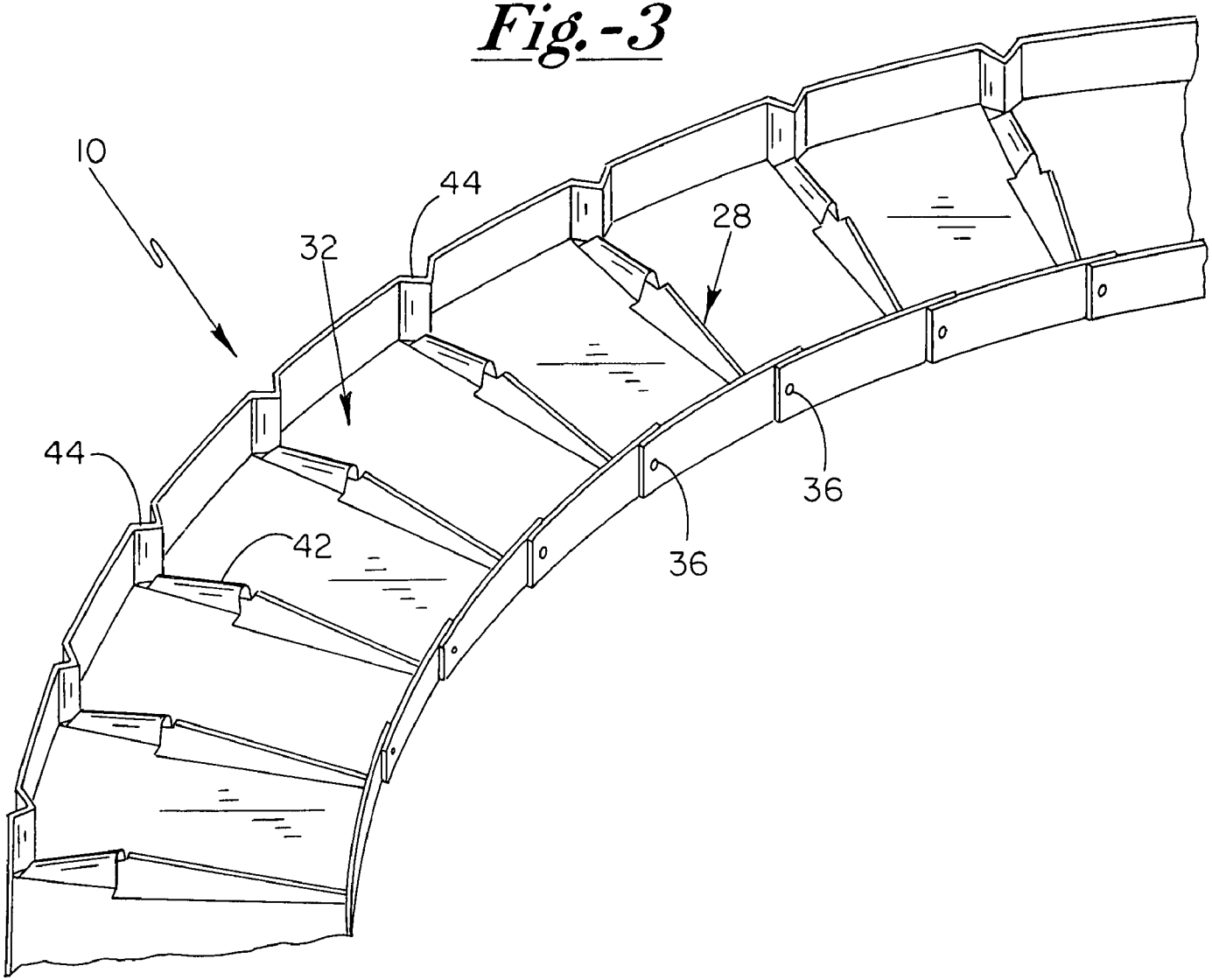
FIG. 3 is a perspective view of the structural alignment member illustrated in FIG. 1 in a curved orientation.
Figure 4:
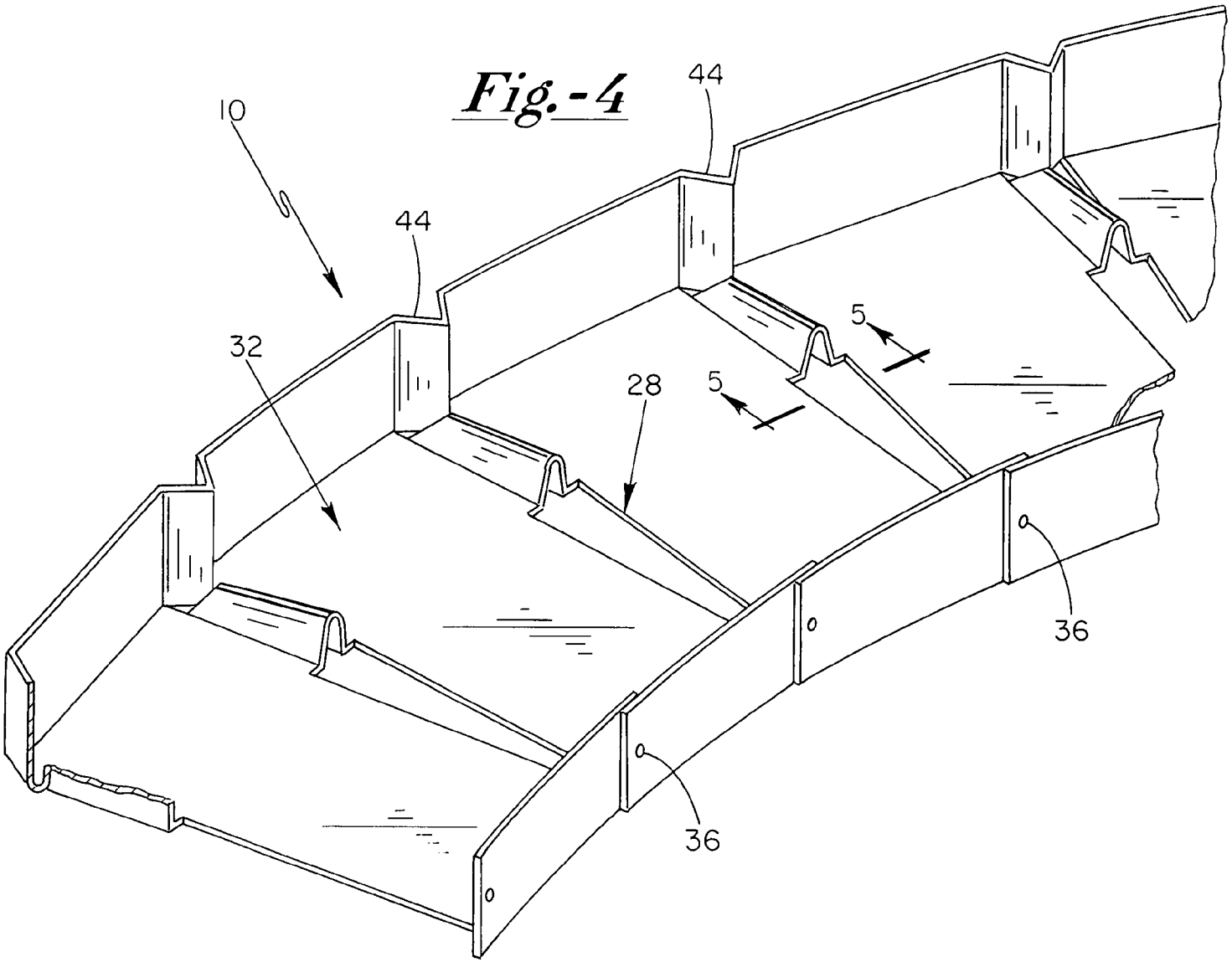
FIG. 4 is an enlarged perspective view of the structural alignment member illustrated in FIG. 3.

An example of such non-linear and/or non-planar configurations for structural alignment member 10 effectuated through the overlapping and fastening arrangement described above is shown in FIGS. 3 and 4. In order to maintain structural alignment member 10 in the configuration illustrated in FIG. 3, fasteners are inserted through respective fastener apertures 36, and subsequently through the overlapped portions of respective adjacent second end flange portion. Respective adjacent support member receptor portions 32, through the flexibility characteristics described above, may be twisted, tilted, or turned with respect to adjacent receptor portions 32. Thus, structural alignment member 10 may be manipulated into a wide variety of configurations which may be linear, non-linear, planar, non-planar, or combinations thereof. Such varied configurations are an important aspect of the present invention for enabling the construction of curved and/or non-planar structural surfaces, such as walls, ceilings, or the like. Such structural surfaces are created by the fact that structural support members are aligned and held as described above in respective support member receptor portions 32 of structural alignment member 10.

Figure 7:
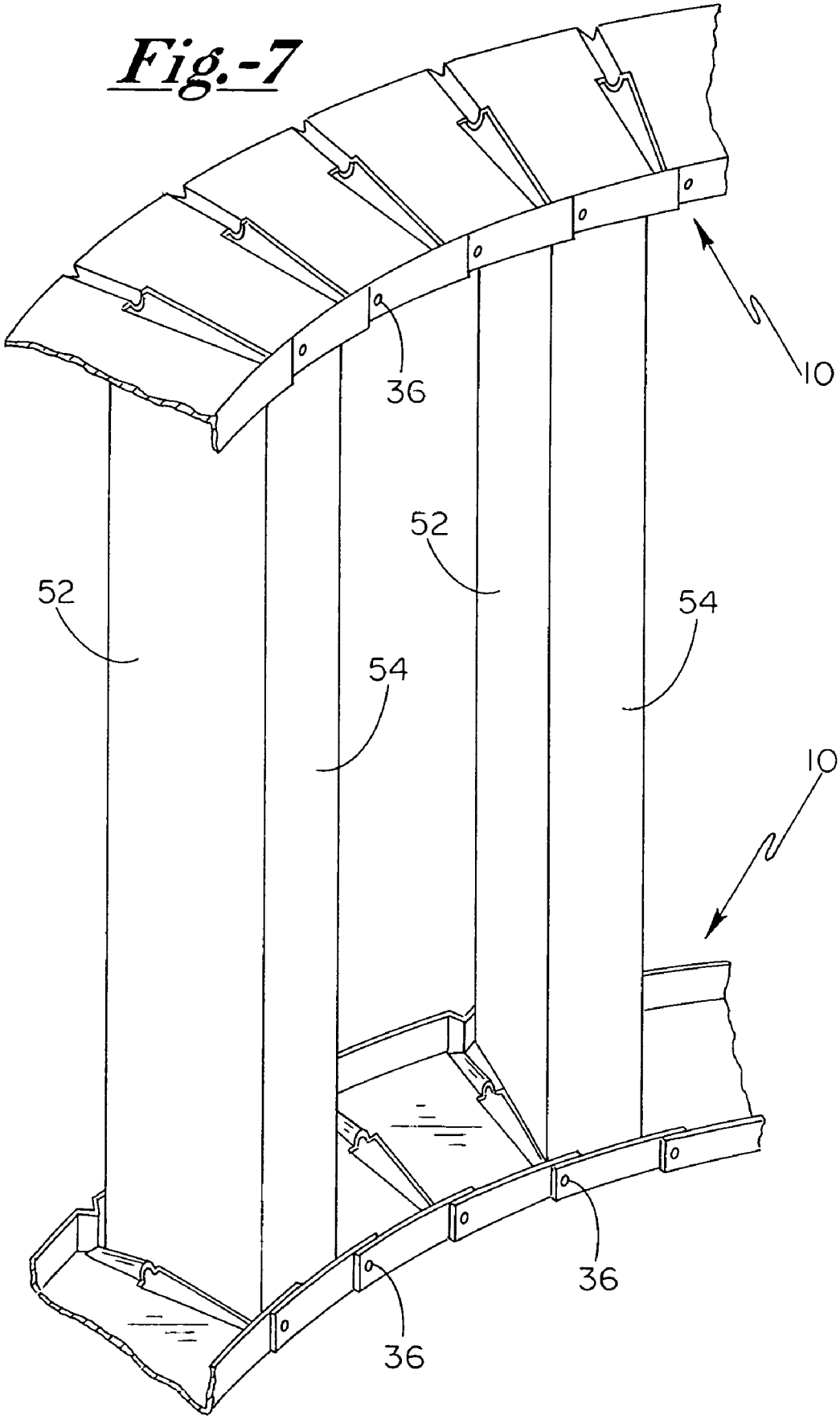
FIG. 7 is a perspective view of a curved wall support arrangement formed by structural support members of the present invention.

An example of a curved wall constructed through the use of two structural alignment members 10 is illustrated in FIG. 7. As shown therein, structural support members such as studs 52 are relatively aligned and secured between top and bottom structural alignment members 10 in order to obtain a curved structural support skeleton upon which a curved surface may be obtained by attaching sheathing material to respective outer edges 54 of structural support members 52.

With reference back to FIGS. 1 and 2, an additional important aspect of the present invention is developed through pre-formed creases 42, 44 in base portion 12 and first end flange 14, respectively. Though the present invention contemplates embodiments incorporating only first preformed creases 42 or second preformed creases 44, it is most preferred to utilize both first and second preformed creases 42, 44 along a length of structural alignment member 10. As shown in FIGS. 1 and 2, first and second preformed creases 42, 44 are preferably positioned at respective junctions of adjacent support member receptor portions 32, and, in particular, at an apex of relative motion between such adjacent support member receptor portions 32.

Preformed creases 42, 44 are specifically configured so as to assist in the flexibility characteristics of structural alignment member 10 by focusing expansion and contraction forces thereat, and providing for expansion and contraction maneuverability between adjacent such receptor portions 32. In the curved embodiment of structural alignment member 10 illustrated in FIG. 3, manipulation of respective adjacent support member receptor portions 32 into a desired extent of overlapping at second end flange 16 results in drawing support member receptor portions 32 toward one another at base portion 12. To accommodate such movement, respective first preformed creases 42 each contract together such that apex 43 of each respective crease 42 extends upwardly. Likewise, first end flange 14 experiences expansive forces along longitudinal axis "L" in the manipulation of respective support member receptor portions 32 toward one another. Second preformed creases 44 therefore accommodate such expansive forces by spreading outwardly. Such first and second preformed creases 42, 44 further absorb and accommodate forces generated in manipulating respective support member receptor portions 32 into relative non-planar orientations.

First and second preformed creases 42, 44 are preferably formed in member 10 through the process described in U.S. Pat. No. 6,138,359 that is owned by the same entity as that in the present application. The contents of U.S. Pat. No. 6,138,359 are herein incorporated by reference.

First and second preformed creases 42, 44 are preferably specifically configured so as to not only provide the flexibility characteristics described above, but also to provide strength in retaining a designated shape of structural alignment member 10. Applicant has found that in embodiments incorporating both first and second preformed creases 42, 44, a merge point 47 formed at the junction between respective first and second preformed creases 42, 44 assists in strengthening and minimizing the latent resiliency of structural alignment member 10. In other words, preformed creases 42, 44, as well as the respective merge points, assist in eliminating undue resiliency to the overall length of alignment member 10. Such a characteristic is important in the field of construction for providing a sturdy and constant-shaped support and alignment device in which to place respective structural support members 52. Through such characteristics, users may rely upon a configuration set to structural alignment member 10 for creating a pre-determined structural support design.

Figure 5:
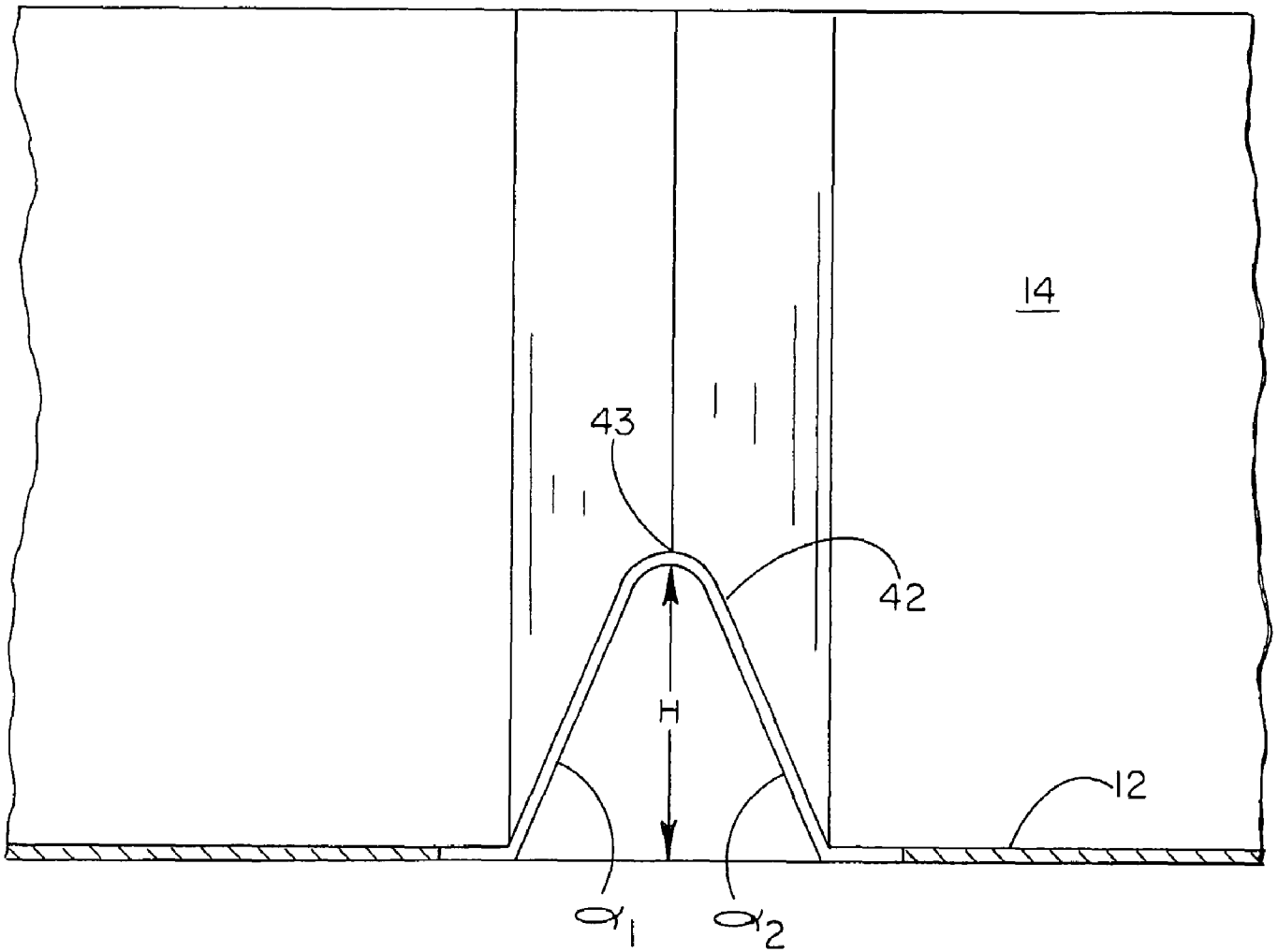
FIG. 5 is a cross-sectional view of a portion of the structural alignment member illustrated in FIG. 4.

Each of first and second preformed creases 42, 44 have an initial dimension along longitudinal axis "L" of between about 0.25 and about 2 inches as measured along longitudinal axis "L". Such dimension, however, is changed when the second flange portions are operably manipulated as described above. The extent to which each of first and second preformed creases 42, 44 initially extend from the corresponding base portion 12 or first flange 14 is illustrated in FIG. 5. Preferably, respective apexes 43, 45 of first and second performed creases 42, 44 have a height dimension "H" of between about 0.125 and about 1 inch. Moreover, first and second preformed creases preferably have angles $\alpha_1$ and $\alpha_2$ being between about 45 and about 75 degrees. Such an initial configuration illustrated in FIG. 5 with respect to first preformed crease 42 is preferably substantially identical for second preformed crease 44. It has been determined by the applicants that first and second preformed creases 42, 44 provide strength and rigidity to alignment member 10 both in an unstressed initial configuration, as well as subsequent to bending and forming operations wherein first and second preformed creases 42, 44 are altered in configuration with respect to that illustrated in FIG. 5.

Figure 6:
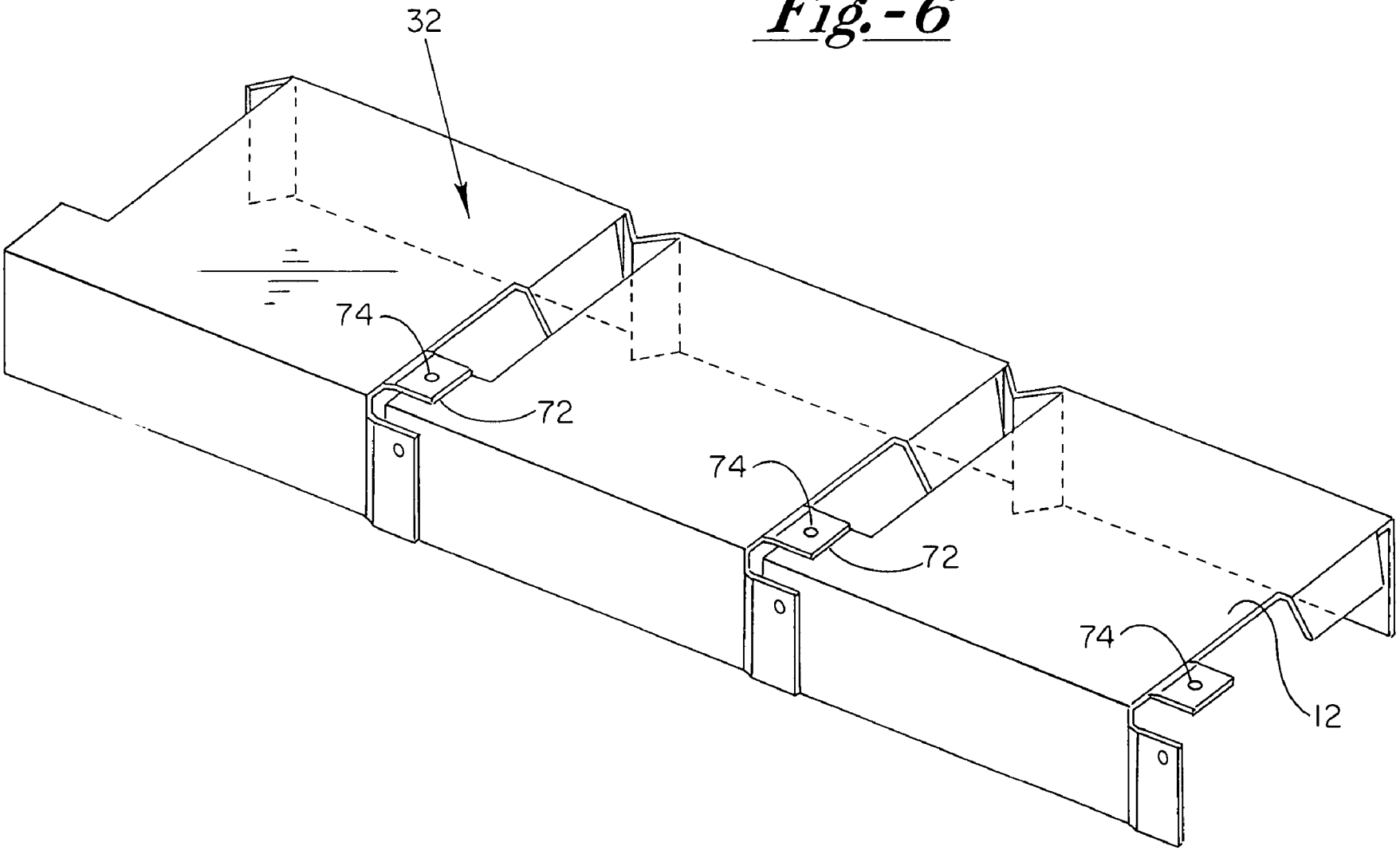
FIG. 6 is a perspective view of a structural alignment member of the present invention.

A further embodiment of the present invention is illustrated in FIG. 6, wherein each receptor portion 32 of base portion 12 includes an overlay tab 72 extending along longitudinal axis "L". Each overlay tab 72 preferably further includes a fastening aperture 74 disposed therein, such that a fastener may operably secure overlay tab 72 to an overlapped base portion of an adjacent receptor portion 32. In such a manner, overlay tabs 72 provide a further location for the user to secure adjacent receptor portions in desired orientations with respect to one another. Overlay tabs 72 are particularly useful in embodiments wherein access to the second flange portions is difficult or impossible. As such, overlay tabs 72 provide and additional or alternative location to fixedly secure adjacent receptor portions 32 of alignment member 10.

Preferably, structural alignment member 10 may be fabricated in a variety of sizes, including custom sizes and standard sizes such as in 10 foot lengths. Preferably, structural alignment member 10 is fabricated from a relatively durable, ductile, and strong material that can be re-formed into a desired configuration post-manufacture. For example, structural alignment member 10 may be fabricated from galvanized steel, aluminum, or the like.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different methods and that various modifications can be accomplished without departing from the scope of the invention itself.

What is claimed is:

1. A structural alignment member for use in operably receiving a structural support member, said structural alignment member comprising:

a single-piece main body being partially separated into a plurality of support member receptor portions, said main body having:

(a) a base partially separated into a series of base portions each associated with a support member receptor portion;

(b) a first end flange extending substantially perpendicularly from a first side of the base portion and further extending substantially along a length of said base portion;

(c) a first crease in said first end flange, said first crease including a first apex that is spaced from a plane of a portion of said first end flange adjacent to said first crease;

(d) a second crease in said base portion, said second crease including a second apex that is spaced from a plane of a portion of said base portion adjacent to said second crease, wherein said first and second creases coextensively meet at a merge point and integrally connect respective adjacent support member receptor portions to permit said support member receptor portions to be repositioned with respect to one another along a plurality of distinct planes; and (e) a second end flange extending substantially perpendicularly from a second side of said base portion and further extending substantially along said length of said base portion, said second end flange being separated into a series of separated and overlapping end flange portions each associated with a respective support member receptor portion.

2. A structural alignment member as in claim 1, including one or more overlay tabs longitudinally extending from the base portions of respective support member receptor portions to thereby operable overlap adjacent support member receptor portions.

3. A structural alignment member as in claim 2 wherein each of said overlay tabs include a fastener aperture therein.

4. A structural alignment member as in claim 1 wherein said first and second creases are formed prior to repositioning of said support member receptor portions.

5. A structural alignment member as in claim 1, including a fastener aperture disposed in each of said end flange portions.

* * * * *